US012624612B2

(12) United States Patent
Fitzsimons et al.

(10) Patent No.: US 12,624,612 B2
(45) Date of Patent: May 12, 2026

(54) INFLATABLE DOWN HOLE BAG

(71) Applicant: MTI GROUP PTY LTD, Wangara (AU)

(72) Inventors: James Matthew Richard Fitzsimons, Wangara (AU); Nicholas Bodley, Wangara (AU); Jamie Smith, Wangara (AU)

(73) Assignee: MTI GROUP PTY LTD (AU)

( * ) Notice: Subject to any disclaimer, the term of this patent is extended or adjusted under 35 U.S.C. 154(b) by 0 days.

(21) Appl. No.: 18/868,664

(22) PCT Filed: May 23, 2023

(86) PCT No.: PCT/AU2023/050434
§ 371 (c)(1),
(2) Date: Nov. 22, 2024

(87) PCT Pub. No.: WO2023/225709
PCT Pub. Date: Nov. 30, 2023

(65) Prior Publication Data

US 2025/0354450 A1 Nov. 20, 2025

(30) Foreign Application Priority Data

May 23, 2022 (AU) ..... 2022901389

(51) Int. Cl.
*E21B 33/127* (2006.01)
*F42D 1/18* (2006.01)

(52) U.S. Cl.
CPC ..... *E21B 33/1277* (2013.01); *F42D 1/18* (2013.01)

(58) Field of Classification Search
CPC ... E21B 23/065; E21B 33/127; E21B 24/1243
See application file for complete search history.

(56) References Cited

U.S. PATENT DOCUMENTS 4,846,278 A 7/1989 Robbins
2015/0211325 A1* 7/2015 Jenkins ..... B01J 7/02 206/219

(Continued)

FOREIGN PATENT DOCUMENTS

AU 2020100966 A4 7/2021
AU 2021107397 A4 12/2021
WO WO-2020077419 A1 * 4/2020 ..... F42D 1/18

OTHER PUBLICATIONS

Burgess, Andrew, International Preliminary Report on Patentability (under Chapter II) for PCT Application No. PCT/AU2023/050434, filed May 23, 2023, mailed Aug. 5, 2024, 26 pages.

(Continued)

*Primary Examiner* — Yanick A Akaragwe
(74) *Attorney, Agent, or Firm* — Smith, Gambrell & Russell, LLP

(57) ABSTRACT

An inflatable down hole bag for insertion into a blast hole, comprising: a sealed inflatable body; a first substance within the sealed inflatable body; a plurality of tablets separated from the first substance within the sealed inflatable body; and a release for allowing the first substance to contact the tablets; wherein the tablets comprise a second substance, and wherein contact between the first substance and the second substance causes an inflation fluid producing reaction within the sealed inflatable body, thereby inflating the inflatable body, wherein the tablets are configured to fragment after contact with the first substance.

16 Claims, 3 Drawing Sheets

(56) References Cited

U.S. PATENT DOCUMENTS

| | | | | |
|---|---|---|---|---|
| 2016/0194546 | A1* | 7/2016 | Fuller | C09K 8/506 166/292 |
| 2019/0048250 | A1* | 2/2019 | Droger | E21B 33/14 |
| 2021/0054716 | A1* | 2/2021 | Al-Mousa | E21B 33/138 |
| 2021/0230955 | A1 | 7/2021 | Bodley et al. | |
| 2023/0167710 | A1* | 6/2023 | Ramasamy | E21B 34/10 166/376 |

OTHER PUBLICATIONS

Pharma Education Team, "Disintegrants Used in Pharmaceutical Preparations," PharmaEducation.Net, accessed at: https://web.archive.org/web/20211205162742/https://pharmaeducation.net/disintegrants/, retrieved May 15, 2024, 5 pages.

Pharma Virtual Lab by Roquette, "About starch as wet granulation binder," accessed at: https://web.archive.org/web/20220521061010/https://www.roquette.com/innovation-hub/pharma/expert-opinion/starch-wet-granulation-binder, retrieved Jul. 30, 2024, 9 pages.

Salindo, Ericson, International Search Report and Written Opinion for PCT/AU2023/050434, filed May 23, 2023, mailed Jul. 14, 2023, 8 pages.

Seager, R. et al., "Solid Dissolution in a Fluid Solvent is Characterized by the Interplay of Surface Area-Dependent Diffusion and Physical Fragmentation," Scientific Reports 8, 7711, May 16, 2018, 17 pages.

* cited by examiner

INFLATABLE DOWN HOLE BAG

FIELD OF THE INVENTION

The present invention relates to an inflatable down hole bag for stemming a blast hole to confine energy released from an explosive charge.

BACKGROUND

In underground and surface mining, blasting is commonly used, in which explosive charges are detonated inside a bore hole at a desired depth.

Where a blast hole is left open, explosive energy can be lost through stemming ejection, reducing the efficiency of the blast.

To counter this loss of energy, blast holes are often plugged or stemmed by inserting a device to fill the hole between the surface and the explosive charge, thus preventing the loss of energy and increasing the effectiveness of the explosive charge.

Such devices include plugs of clay or foam, or inflatable blast hole plugs, examples of which are provided by the present applicant.

An example of an inflatable blast hole plug is a bag suitable for insertion into the blast hole, the bag containing two substances that, when mixed, release a gas to cause expansion of the bag, thus filling the bore of the blast hole.

Inflatable blast hole plugs are activated by the operator to cause the substances to mix and the gas to release, and then lowered (or raised) into a hole to a sufficient height to block the hole.

Once the release of gas starts, it cannot be stopped or slowed and accelerates as an uncontrolled chemical reaction, meaning that the operator will only have a limited time to place the bag at the correct height. Where the time is insufficient the bag will become lodged and must be removed by the operator perforating and removing the bag.

Conversely, an especially slow, or delayed, reaction is undesirable as an operator must either wait for the bag to inflate sufficiently to support its own weight or take action to hold the bag in position.

A blasting operation can be undertaken on a large number of blast holes simultaneously, and the preparation of each blast hole can take significant time and must be performed by suitably qualified operators.

As the blast hole plugs must be inserted into multiple blast holes, any improvement directed to increasing the speed or efficiency of preparation is desirable.

It is against this background that the invention is presented.

The following discussion of the background art is intended to facilitate an understanding of the present invention only. It should be appreciated that the discussion is not an acknowledgement or admission that any of the material referred to was part of the common general knowledge as at the priority date of the application.

Throughout the specification unless the context requires otherwise, the word "comprise" or variations such as "comprises" or "comprising", will be understood to imply the inclusion of a stated integer or group of integers but not the exclusion of any other integer or group of integers.

Throughout the specification unless the context requires otherwise, the word "include" or variations such as "includes" or "including", will be understood to imply the inclusion of a stated integer or group of integers but not the exclusion of any other integer or group of integers.

SUMMARY OF INVENTION

According to a first aspect of the present invention, there is provided an inflatable down hole bag for insertion into a blast hole, comprising:

- a sealed inflatable body;
- a first substance within the sealed inflatable body;
- a plurality of tablets separated from the first substance within the sealed inflatable body; and
- a release for allowing the first substance to contact the tablets;
- wherein the tablets comprise a second substance, and wherein contact between the first substance and the second substance causes an inflation fluid producing reaction within the sealed inflatable body, thereby inflating the inflatable body, wherein the tablets are configured to fragment after contact with the first substance.

According to a second aspect of the present invention, there is provided an inflatable down hole bag for insertion into a blast hole, comprising:

- a sealed inflatable body;
- a first substance within the sealed inflatable body;
- a second substance in tablet form separated from the first substance within the sealed inflatable body; and
- a release for allowing the first substance to contact the second substance;
- wherein contact between the first substance and the second substance causes an inflation fluid producing reaction within the sealed inflatable body, thereby inflating the inflatable body, wherein the tablets are configured to fragment after contact with the first substance.

According to a third aspect of the present invention, there is provided an inflatable down hole bag for insertion into a blast hole, comprising:

- a sealed inflatable body having first and second separable portions,
- a first substance within the first portion,
- a second substance in tablet form in the second portion,
- a release for allowing the first and second substances to contact one another;
- wherein contact between the first substance and the second substance causes an inflation fluid producing reaction within the sealed inflatable body, thereby inflating the inflatable body, wherein an initial inflation fluid production rate is lower than a subsequent inflation fluid production rate.

According to a fourth aspect of the present invention, there is provided an inflatable down hole bag for insertion into a blast hole, comprising:

- a sealed inflatable body having first and second separable portions,
- a first substance within the first portion,
- at least one tablet in the second portion,
- a release for allowing the first substance and the at least one tablet to contact one another;
- wherein contact between the first substance and the at least one tablet causes a controlled inflation fluid producing reaction within the sealed inflatable body, thereby inflating the inflatable body, wherein an initial inflation fluid production rate is lower than a subsequent inflation fluid production rate.

According to a fifth aspect of the present invention, there is provided an inflatable down hole bag for insertion into a blast hole, comprising:

a sealed inflatable body;

a first substance within the sealed inflatable body;

a plurality of tablets separated from the first substance within the sealed inflatable body; and a release for allowing the first substance to contact the tablets;

wherein the tablets comprise a second substance and a third substance, and wherein contact between the first substance and the second substance causes an inflation fluid producing reaction within the sealed inflatable body, thereby inflating the inflatable body, and wherein the third substance is configured to cause the tablet to fragment.

According to a sixth aspect of the present invention, there is provided an inflatable down hole bag for insertion into a blast hole, comprising:

a sealed inflatable body;

a first substance within the sealed inflatable body;

a plurality of tablets separated from the first substance within the sealed inflatable body; and a release for allowing the first substance to contact the tablets;

wherein the tablets comprise a reagent, and a disintegrant.

According to a seventh aspect of the present invention, there is provided an inflatable down hole bag for insertion into a blast hole, comprising:

a sealed inflatable body;

a first substance within the sealed inflatable body;

a plurality of tablets separated from the first substance within the sealed inflatable body; and a release for allowing the first substance to contact the tablets;

wherein the tablets are configured to cause the bag to inflate according to a selected inflation profile, wherein the profile is defined by physical properties and composition of the tablets.

According to a eighth aspect of the present invention, there is provided a tablet for use in an inflatable down hole bag for insertion into a blast hole, the tablet comprising a reagent and a disintegrant, wherein the reagent is configured to cause an inflation fluid producing reaction upon contact with acid, and wherein the disintegrant is configured cause the tablet to fragment, and wherein physical characteristics of the tablet are selected according to a desired duration between the commencement of the reaction and commencement of the fragmentation of the tablet.

In an embodiment, the tablet further comprises a binder for binding the reagent and disintegrant together.

In an embodiment, the binder causes the duration to be extended.

In an embodiment, the physical characteristic of the tablet comprise any of; the size and geometric shape of the table, the overall surface area of the tablet, or of a plurality of tablets in the bag, the proportions of the reagent and disintegrant, the granular size and shape of the reagent and disintegrant, the amount, and type of binder included, and the pressure under which the tablet is pressed.

Unless the contrary is apparent, embodiments of the above-described principal aspects, and any of those described below, may comprise or incorporate, either individually or in combination, any of the following features.

In an embodiment, the tablets are of substantially homogenous composition.

In an embodiment, the second substance extends to an outermost surface of the tablet.

In an embodiment, the plurality of tablets comprises at least two different types, wherein different types are configured to have different inflation characteristics, and wherein different types are selected according to a desired inflation profile of the bag.

In an embodiment, the inflation fluid producing reaction starts when the tablet contacts the first substance.

In an embodiment, the first substance is in liquid form.

In an embodiment, the first substance comprises an acid.

In an embodiment, the first substance is acidic.

In an embodiment, the second substance comprises a reagent.

In an embodiment, the reagent comprises a carbonate or bicarbonate salt, preferably a sodium salt.

In an embodiment, the reagent comprises a gas producing chemical.

In an embodiment, the tablets further comprise a third substance configured to cause the tablet to fragment.

In an embodiment, the tablets further comprise a third substance configured to absorb fluid and expand.

In an embodiment the expansion of the third substance causes the tablet to fragment once sufficient fluid has been absorbed.

In an embodiment, the third substance comprises a disintegrant.

In an embodiment, the disintegrant contains starch.

In an embodiment, the tablets further comprise a binder.

In an embodiment, the binder is configured to bind the second and third substances together.

In an embodiment, the tablets further comprise a lubricant.

In an embodiment, the lubricant comprises Polyethylene Glycol, also known as PEG6000.

In an embodiment, the tablets are between 1 mm and 50 mm across a largest dimension.

In an embodiment, the tablets are between 5 mm and 20 mm across a largest dimension.

In an embodiment, the tablets are comprised of up to 90% reagent.

In an embodiment, the tablets are comprised of at least 75% % reagent.

In an embodiment, the tablets comprise at least 5% third substance.

In an embodiment, the tablets comprise no more than 20% third substance.

In an embodiment, the second and third substances are in powder form.

In an embodiment, the second and/or third substances comprise granules that are substantially homogenously distributed throughout the tablet.

In an embodiment, granular size of the second substance is selected according to a desired initial inflation fluid production rate.

In an embodiment, proportion and/or granular size of the third substance is selected according to a desired duration of initial inflation fluid production rate.

In an embodiment, characteristics of the inflation fluid production of the tablet are defined according to at least one of; proportion and granular size of the first substance, second substance and third substance, and the volume and type of binder.

In an embodiment, characteristics of the inflation fluid production comprise any of; rate and/or duration of the inflation fluid production in an initial stage, rate of change of rate of inflation fluid production following the initial stage, rate and/or duration of the inflation fluid production in a subsequent stage, and total volume of inflation fluid produced.

In an embodiment the duration of the initial stage is determined by the third substance causing the disintegration of the tablet.

In an embodiment, the tablets comprise an inner portion comprising the second substance, and an outer shell comprising the third substance.

In an embodiment, the inflatable body comprises a pocket for holding the first substance prior to contact with the second substance.

In an embodiment, the pocket remains until at least the inflation fluid is produced.

In an embodiment, the first substance is substantially contained within the pocket of the sealed inflatable body.

In an embodiment, the tablets are contained within a container.

In an embodiment, the quantity and size of the tablets within the container are known, so that a total surface area of second substance for reaction with the first substance is also known.

In an embodiment, the release comprises a mechanism for releasing the tablets from the container.

According to a ninth embodiment of the present invention, there is provided a method of inflating a down hole bag, comprising:

providing an inflatable down hole bag having a sealed inflatable body, the body comprising a fluid first substance, and a second substance in tablet form separated from the first substance within the sealed inflatable body;

activating a release allowing the second substance to contact the first substance causing an inflation fluid producing reaction within the inflatable body, thereby inflating the inflatable body, wherein the tablets are configured to fragment after a selected period of contact with the first substance.

In an embodiment, the method further comprises the steps of:

inserting the bag into a blast hole after activating the release, and maintaining the bag at a desired position until sufficiently inflated that the bag remains in position in the blast hole.

According a tenth embodiment of the present invention, there is provided a method of fabricating an inflatable down hole bag for insertion in a bore hole, the method comprising:

at least partially filling the bag with a first substance, compressing a mixture in a die to form at least one tablet, the mixture comprising a second substance and a third substance, locating the at least one tablet in the bag separated from the first substance, sealing the body.

In an embodiment, including in the mixture a binder.

In an embodiment, including in the mixture a lubricant.

In an embodiment, selecting the composition of the mixture according to a desired inflation profile of the bag.

In an embodiment, ensuring the mixture comprises at least 80% second substance.

In an embodiment, ensuring the mixture comprises no more than 20% third substance.

In an embodiment, a composition of the mixture is selected according to a desired duration of initial inflation fluid production rate.

In an embodiment, granular size of the second substance in the mixture is selected according to a desired initial inflation fluid production rate.

In an embodiment, proportion and/or granular size of the third substance in the mixture is selected according to a desired duration of initial inflation fluid production rate.

In an embodiment, characteristics of the inflation fluid production of the tablet are defined according to at least one of; proportion and granular size of the first substance, second substance and third substance, and the volume and type of binder.

In an embodiment, the physical characteristics of the tablet comprise any of; size and geometric shape of the table, overall surface area of the tablet, or of a plurality of tablets in the bag, proportions of the reagent and disintegrant, granular size and shape of reagent and disintegrant, amount and type of binder included, and pressure under which the tablet is pressed.

BRIEF DESCRIPTION OF DRAWINGS

In order to provide a better understanding, embodiments of the present invention will be described, by way of example only, with reference to the accompanying drawings, in which.

DESCRIPTION OF EMBODIMENTS

Figure 1A:
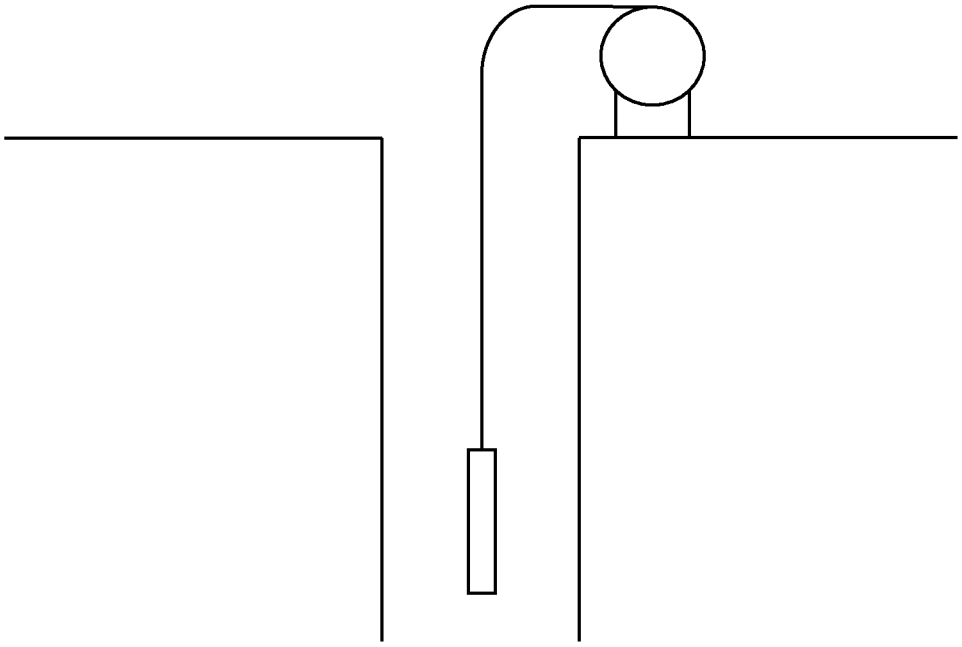
FIG. 1*a* is a cross-section view of a blast hole having an inflatable blast hole bag being lowered into the hole as is known in the art.
Figure 1B:
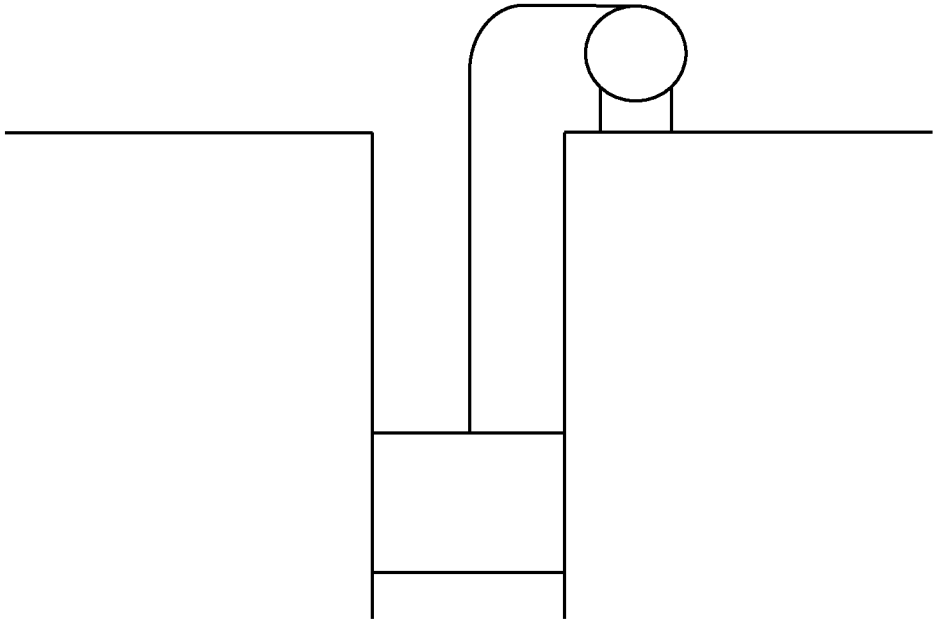
FIG. 1*b* is a cross-section view of a blast hole with a blast hole bag inflated within the bore of the hole, so that the hole is stemmed, as is known in the art.

Referring to FIGS. 1*a* and 1*b*, there is shown a blast hole having an inflatable down hole bag exemplary of a type known in the art.

The bag is inserted into the hole and inflates until the bag is sufficiently large that the blast hole is plugged.

Bags that rely on a gas producing reaction to inflate require that the bag is activated prior to insertion, thus initiating a reaction that cannot be stopped or slowed, and allowing an operator limited time to locate the bag at the correct position.

Although the bag is depicted being lowered into a vertical blast hole, the use of inflatable down hole bags is not limited as such, and can be inserted upwardly, horizontally or at any angle according to the orientation of the blast hole.

Figure 2:
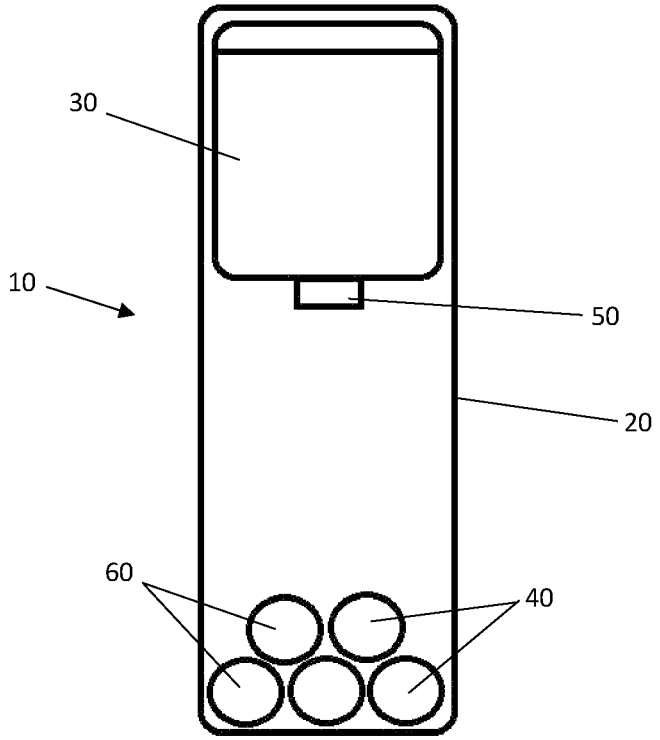
FIG. 2 is a cross-section view of an inflatable down hole bag according to an embodiment of the present invention, in which the first and second substances are shown separated.
Figure 3:
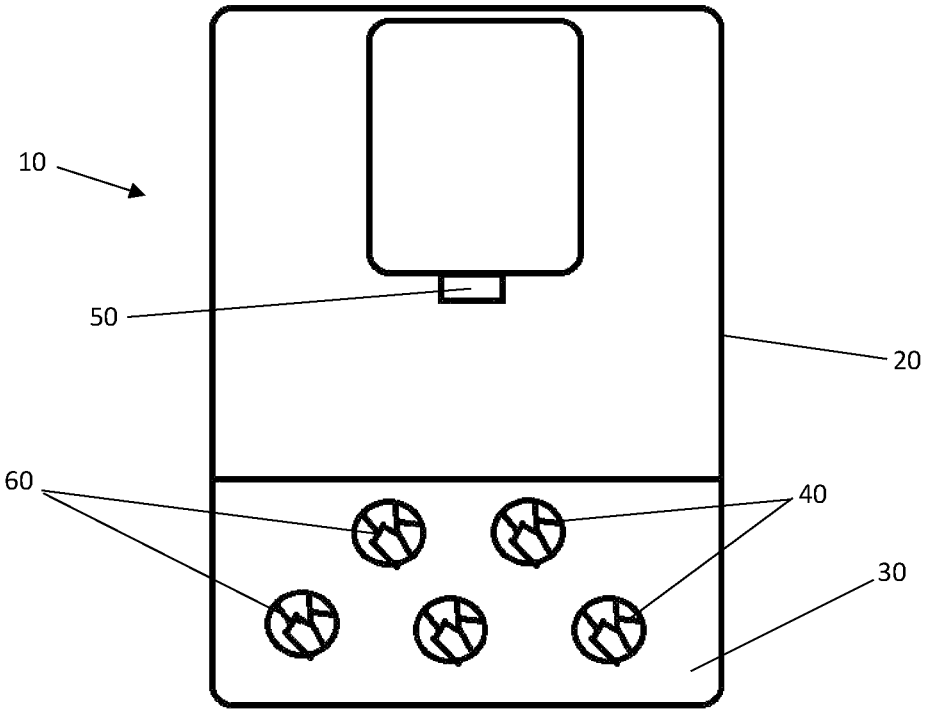
FIG. 3 is a cross-section view of an inflatable down hole bag according to an embodiment of the present invention, in which the first and second substances are shown in contact, with the bag expanded due to the inflation fluid producing reaction.
Figure 4A:
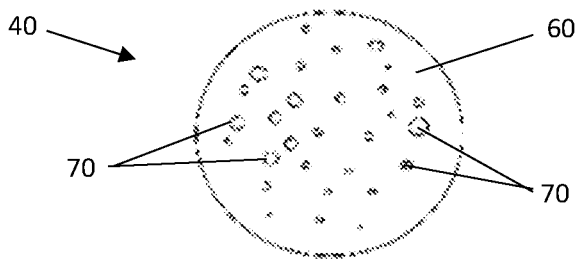
FIG. 4*a* is a side view of a tablet as used in the present invention, in which the tablet is shown in its initial full form.
Figure 4B:
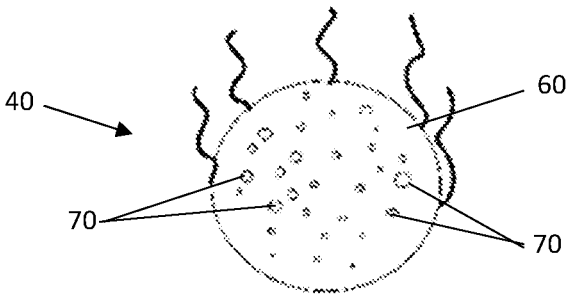
FIG. 4*b* is a side view of a tablet as used in the present invention, in which the tablet is shown upon initial contact with the first substance.
Figure 4C:
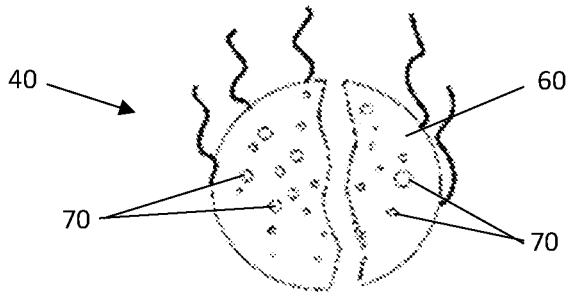
FIG. 4*c* is a side view of a tablet as used in the present invention, in which the tablet is shown beginning to fragment after contact with the first substance.
Figure 4D:
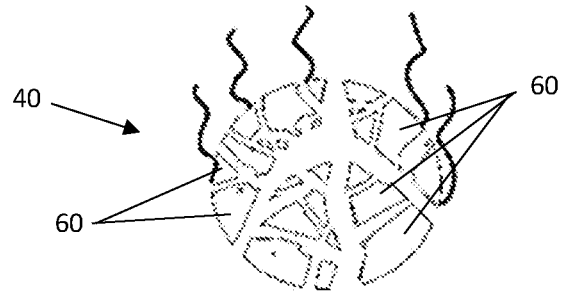
FIG. 4*d* is a side view of a tablet as used in the present invention, in which the tablet is shown further fragmenting after prolonged contact with the first substance.

Referring to FIGS. 2 and 3, there is shown an inflatable blast hole bag 10 for insertion into a blast hole according to an embodiment of the present invention, the bag 10 comprising a sealed inflatable body 20 for holding an inflation fluid, a first substance 30 within the sealed inflatable body, a second substance 60 in tablet form separated from the first substance 30 within the sealed inflatable body 20 and a release 50 for allowing the first substance 30 to contact the second substance 60; wherein contact between the first substance 30 and the second substance 60 causes an inflation fluid producing reaction within the sealed inflatable body 20, thereby inflating the inflatable body 20.

The first substance may be comprised within a first portion of the inflatable body 20. The second substance may be comprised within a second portion of the inflatable body 20.

The second substance 60 may be provided as one or more tablets 40. Tablets 40 may be of conventional tablet shape as known in the art. Example shapes include disc-shaped, spherical, cube shaped, rectangular prism or other polyhedrons.

Alternatively, tablets 40 may be of complex shape providing increased surface area.

The tablet form of the second substance 60 advantageously allows a total surface area available for reaction to be better calculated than where the second substance 60 is provided in powder or liquid form.

The reduced surface area of the second substance 60 in tablet form when compared to powder form slows the reaction, thus allowing more time for an operator to locate a bag 10 at the desired position in the blast hole. Although coarse grain powder can decrease the available surface area compared to fine grain powder, the extent to which this is advantageous is limited, and further reduction in surface area is advantageous.

The second substance 60 being in tablet form also provides easier handling during production. An example of such an advantage is an operator being able to count a number of tablets which are added to a bag for a particular configuration, as opposed to measuring a quantity of powder and pouring the correct quantity to the bag, which carries a high likelihood of loss of some powder, in addition to variations in measurement.

Fewer tablets 40 equates to easier handling during production, although having reduced surface area, therefore the use of tablets having more complex shapes (larger surface area) may be beneficial where the tablets are larger, or where fewer or a single tablets are used.

The tablet 40 form further ameliorates a problem of powder becoming lodged in inaccessible areas of the bag 10, for example during storage and transportation, resulting in insufficient reaction and potentially inadequate inflation to fill the blast hole and retain the inflatable down hole bag 10.

Tablets 40 that are less able to become lodged in inaccessible areas of the bag 10 also results in less wastage of product.

The first substance 30 may be in liquid form. The first substance 30 may comprise an acid or may be acidic. For example, the acid may be citric acid or acetic acid.

The second substance 60 may comprise a reagent. The reagent may comprise a carbonate or bicarbonate salt, for example a sodium salt. Preferably the reagent is sodium bicarbonate. The reagent may comprise a mixture of different elements. The reagent may comprise a gas producing chemical.

Referring to FIGS. 4*a* to 4*d*, the tablets 40 may further comprise a third substance 70 configured to absorb fluid and expand. The expansion of the third substance 70 may cause the tablet 40 to fragment once sufficient fluid has been absorbed. The third substance 70 may comprise a disintegrant, one example of which is starch.

The third substance may comprise a clay, for example Veegum HV or bentonite.

The third substance may comprise a cellulose derivate such as AC-Di-Sol.

The third substance may comprise a cross-linked Polyvinylpyrrolidone.

The addition of a third substance 70 into the tablet 40 causes the available surface area for reaction to increase as the tablet 40 fragments. The increased surface area for reaction results in an increased rate of production of inflation fluid, and therefore increased rate of inflation.

The tablets may further comprise a binder (not shown) for binding the second and third substances together. The binder increases the structural integrity of the tablet 40, which prevents the tablet 40 from breaking apart too quickly, and further reduces the likelihood of the tablet fragmenting before use, during transportation and handling for example.

Examples of binder include starch paste, gelatin, and cellulose, such as methyl cellulose and ethyl cellulose.

The tablets may further comprise a lubricant (not shown). The lubricant may prevent the tablet from sticking in the tool during manufacture, or from becoming lodged in the body 20, thus increasing reliability of the bag 10 by decreasing the likelihood of a reaction failing to occur.

In an embodiment, the lubricant comprises Polyethylene Glycol, also known as PEG6000.

Alternatively, the lubricant may comprise any of talc, colloidal silica or mag stearate.

The tablets 40 may be between 1 mm and 50 mm across a largest dimension. Preferably, the tablets 40 may be between 5 mm and 30 mm across a largest dimension. More preferably, the tablets 40 may be between 10 mm and 20 mm across a largest dimension, and between 5 mm and 10 mm in depth. For example, the tablets 40 may be 16 mm diameter disc shaped that are 7 mm in depth.

The tablets 40 may be comprised of up to 90% reagent. The tablets 40 may be comprised of at least 75% reagent. The tablets 40 comprise at least 5% third substance. The tablets 40 may comprise no more than 20% third substance. The tablets 40 may be of substantially homogenous composition.

The preferred composition of each tablet 40 is 85% reagent, 12% disintegrant, 2% binder and 1% lubricant.

The second 60 and third 70 substances may be in powder form, preferably compacted powder forming the tablet.

The second 60 or third 70 substances may comprise granules that are substantially homogenously distributed thought the tablet 40.

The tablets 40 may comprise an inner portion comprising the second substance 60, and an outer shell comprising the third substance 70.

In such an embodiment, an example of the second substance is bicarbonate, and an example of the third substance is carbonate.

The composition of each tablet 40 may vary depending on the desired performance result. For example, the duration and rate of inflation fluid production in the initial stage can be determined by the composition and size of the tablets 40.

The plurality of tablets 40 may include multiple types of tablets 40, each having different inflation characteristics. For example, a first type of tablet 40 may be used in combination with a second type of tablet 40, with the first type providing an initial stage of reaction to a defined volume, and the second type producing a second stage of reaction to a final volume, so that the different types of tablets, when used in combination, provide a desired inflation profile.

Each variation in inflatable bag 10 has an optimum produced volume of inflation fluid, that correlates to the volume of the bag once inflated. Bags 10 may be sized to fit into various types of blast holes, and the total volume of gas produced can be determined by the selected quantities of first 30 and second 60 substances.

The rate and duration of the inflation to reach the fully inflated bag 10 volume is advantageously selected according to the type of hole. For example, smaller diameter holes are more likely to benefit from an initially slow inflation, which increases after a relatively short period of time.

Larger diameter holes may require a greater initial rate of inflation, to be able to secure the bag 10 in the hole more quickly and then move on to a subsequent hole, thereby saving time.

The depth at which bags 10 are to be placed in a hole may also require an initial inflation stage to have a different duration, with bags 10 to be placed at greater depths preferring a greater duration of the initial stage, before fragmentation of the tablet 40 causes the rate of inflation to increase, and the bag 10 to become fixed in position against the walls of the hole.

The different characteristics of the inflation are defined according to an inflation profile, wherein the inflation profile is determined by the varying rate and duration at which inflation fluid is produced within the bag 10.

Whilst it is known to produce inflatable down hole bags of a desired volume, the inflation profile is typically unknown, or at least limited in terms of what can be defined. Conventionally, a defined quantity of reagent is mixed with a defined quantity of acid to produce a defined quantity of gas.

Aside from defining the final volume of gas, very little is able to be defined with regards to the inflation profile, from the activation of the release 50, until the bag 10 is able to retain itself in the blast hole.

This period is the period in which an operator must position and hold the bag, and any time saved is beneficial, and a more predictable inflation profile allows a bag 10 to be designed to suit a particular type and diameter of hole.

The use of tablets 40, including tablets of selected compositions and characteristics, and used alone or in combination, enables the inflation profile of the bag 10 to be configured to suit a particular application, and inflation profile that would not be able to be achieved using conventional means.

The inflatable body 20 may comprise a pocket for holding the first substance 30 prior to contact with the second substance 60. The pocket may remain until at least the inflation fluid is produced. The first substance 30 may be substantially contained within the pocket of the sealed inflatable body 20.

The tablets 40 may be contained within a container. As the quantity and size of the tablets 40 within the container are known, so that a total surface area of second substance 60 for reaction with the first substance 30 is also known. In an embodiment, the release 50 comprises a mechanism for releasing the tablets 40 from the container.

Referring to the figures generally a method of inflating a down hole bag 10 comprises: providing an inflatable down hole bag 10 having a sealed inflatable body 20, the body 20 comprising a fluid first substance 30 and a second substance 60 in tablet form separated from the first substance 30 within the sealed inflatable body 20; activating a release 50 allowing the second substance 60 to contact the first substance 30 causing an inflation fluid producing reaction within the inflatable body 20, thereby inflating the inflatable body 20.

The method may further comprise the steps of: inserting the bag 10 into a blast hole after activating the release 50, and maintaining the bag 10 at a desired position until sufficiently inflated that the bag 10 remains in position in the blast hole.

In a method of fabricating the inflatable down hole bag 10, wherein the inflatable downhole bag 10 comprises a body 20 having first and second separable portions and a release 50 configured to allow fluid communication between the first and second portions, the method comprises: at least partially filling the first or second portion with a first substance 30, compressing a mixture in a die to form at least one tablet 40, the mixture comprising a second substance 60 and a third substance 70, locating the at least one tablet 40 in the other portion, sealing the body 20.

The method may further comprise the step of including in the mixture a binder.

The method may further comprise the step of including in the mixture a lubricant.

The method may further comprise the step of ensuring the mixture comprises at least 80% of the second substance. The method may further comprise the step of ensuring the mixture comprises no more than 20% of the third substance.

In embodiments not comprising a third substance 70, the defined surface area for reaction between the first 30 and second 60 substances allows an operator to more reliably predict the time until the bag 10 is sufficiently expanded to retain itself in the blast hole.

Such embodiments are useful as the time allowed for an operator to place the bag 10 is increased due to the lower rate of inflation afforded by the reduced surface area.

In embodiments comprising a third substance 70, as the tablet 40 does not fragment until sufficient fluid has been absorbed, the overall rate of inflation of the tablet is initially low, and subsequently increases once the tablet 40 fragments.

The two-stage rate of inflation advantageously allows an operator more time to initially place a bag 10, followed by a reduced time until the bag 10 is secured in the blast hole. As the surface area of the tablets 40 available for reaction, and the quantity of first substance 30 can be determined, the time for each stage of reaction can be better predicted.

Increased predictability of first and second stage reaction times is advantageous in that an operator can better determine, and/or select, an appropriate bag 10 configuration for a particular application. The increased predictability allows bags 10 to be provided with first and second stage reaction times being identified with a relatively high degree of certainty, thus allowing operators to select an appropriate configuration of bag 10 and perform the task with confidence that the bag 10 will remain manoeuvrable for a known time and will be reliably secured after a known time.

The first and second stage reaction times is distinct from delayed reaction type arrangements, for example in which tablets are covered with a skin or film that prevents the contact of the different substances until the skin has dissolved.

It has been shown that delayed reaction type arrangements require an operator to hold them in position until the inflation fluid producing reaction commences, and further until the reaction has progressed sufficiently so that the bags remain in place.

In comparison, the inflation producing reaction that commences immediately once the release 50 is activated, but initially inflates at a slower rate (first stage), which increases after a predictable period (second stage), has been shown to be advantageous as it requires less time for the operator to locate and position the bag 10 in the hole.

Whilst the delayed reaction type arrangement may be suitable for some applications, such as underground mines where it is expected that a longer time may be required to insert and position a bag 10, in other situations, for example open cut mines, the bags 10 can be inserted and positioned more quickly.

The invention provided according to the embodiments described herein enables the production of a range of inflatable downhole bags 10, wherein the characteristics of the inflation profile of the bag 10 can be reliably predicted according to the physical characteristics and composition of the tablets 40.

The advantageous effect is multiplied as bags are commonly placed in numerous holes in a single operation, thus the time taken to complete an operation is reduced, and the efficiency is increased (or waste reduced).

Modifications as would be apparent to the person skilled in the art are deemed to be within the scope of the present invention.

The invention claimed is:

1. An inflatable down hole bag for insertion into a blast hole, the inflatable down hole bag comprising:

a sealed inflatable body;

a first substance within the sealed inflatable body;

a plurality of tablets separated from the first substance within the sealed inflatable body; and a release for allowing the first substance to contact the tablets;

wherein:

the tablets comprise a second substance, a third substance, and a binder;

the inflatable down hole bag is configured to cause an inflation-fluid-producing reaction within the sealed inflatable body upon contact between the first substance and the second substance, thereby inflating the inflatable body; and the third substance is configured to cause the tablets to fragment.

2. The inflatable down hole bag according to claim 1, wherein the tablets are configured to start the inflation-fluid-producing reaction upon contact with the first substance.

3. The inflatable down hole bag according to claim 1, wherein the second substance comprises a reagent.

4. The inflatable down hole bag according to claim 3, wherein the tablets are configured to fragment upon expansion of the third substance once sufficient fluid has been absorbed.

5. The inflatable down hole bag according to claim 1, wherein the third substance is configured to absorb fluid and expand.

6. The inflatable down hole bag according to claim 1, wherein the third substance comprises a disintegrant.

7. The inflatable down hole bag according to claim 6, wherein the disintegrant contains starch.

8. The inflatable down hole bag according to claim 1, wherein the tablets are of substantially homogenous composition.

9. The inflatable down hole bag according to claim 1, wherein the tablets further comprise a lubricant.

10. The inflatable down hole bag according to claim 1, wherein the inflatable body comprises a pocket for holding the first substance prior to contact with the second substance.

11. An inflatable down hole bag for insertion into a blast hole, the inflatable down hole bag comprising:

a sealed inflatable body;

a first substance within the sealed inflatable body;

a plurality of tablets separated from the first substance within the sealed inflatable body; and a release for allowing the first substance to contact the tablets;

wherein:

the tablets are configured to cause the bag to inflate according to a selected inflation profile defined by physical properties and composition of the tablets, the inflatable down hole bag is configured to start an inflation-fluid-producing reaction when the tablets contact the first substance, the tablets comprise at least two different types of tablets, wherein two types of the at least two different types have different inflation characteristics, and wherein the two types are selected according to a desired inflation profile of the bag; and the tablets further comprise a binder.

12. A tablet for use in an inflatable down hole bag for insertion into a blast hole, the tablet comprising:

a reagent; and a disintegrant, wherein:

the reagent is configured to cause an inflation fluid producing reaction upon contact with acid, the disintegrant is configured to causes the tablet to fragment, physical characteristics of the tablet are selected according to a desired duration between commencement of the reaction and commencement of the fragmentation of the tablet, and the tablet further comprises a binder for binding the reagent and disintegrant together.

13. The tablet according to claim 12, wherein the binder causes the duration to be extended.

14. A method of fabricating an inflatable down hole bag for insertion in a bore hole, the method comprising:

at least partially filling the bag with a first substance, preparing a mixture, the mixture comprising a second substance, a third substance, and a binder, compressing the mixture in a die to form at least one tablet, locating the at least one tablet in the bag separated from the first substance, and sealing a sealed inflatable body of the inflatable down hole bag.

15. The method according to claim 14, further comprising including in the mixture a lubricant.

16. The method according to claim 14, further comprising selecting the composition of the mixture according to a desired inflation profile of the bag.

* * * * *